US006006841A

United States Patent [19]

Hunke

[11] Patent Number: 6,006,841

[45] Date of Patent: Dec. 28, 1999

[54] FIREFIGHTING APPARATUS WITH IMPROVED HOSE DEPLOYMENT AND RELOADING

[75] Inventor: Jeffrey A. Hunke, Snyder, Nebr.

[73] Assignee: Smeal Fire Apparatus Co., Snyder, Nebr.

[21] Appl. No.: 09/342,626

[22] Filed: Jun. 29, 1999

Related U.S. Application Data

[60] Provisional application No. 60/099,935, Sep. 11, 1998.

[51] Int. Cl.[6] ..... A62C 27/00; A62C 33/00

[52] U.S. Cl. ..... 169/24; 248/90; 296/37.6; 137/355.2; 137/355.28

[58] Field of Search ..... 169/24; 239/195, 239/197; 280/4; 248/89, 90; 296/37.6; 137/355.16, 355.2, 355.28

[56] References Cited

U.S. PATENT DOCUMENTS

| | | | |
|---|---|---|---|
| 790,839 | 5/1905 | Hopkins . | |
| 881,872 | 3/1908 | Sanford . | |
| 1,028,612 | 6/1912 | Schneider . | |
| 2,625,404 | 1/1953 | Treiber . | |
| 4,366,933 | 1/1983 | Broussard . | |
| 4,830,421 | 5/1989 | Hawelka et al. | 169/24 X |
| 5,211,351 | 5/1993 | DeClerck | 137/355.28 X |

*Primary Examiner*—Lesley D. Morris

*Attorney, Agent, or Firm*—Pillsbury Madison & Sutro LLP

[57] ABSTRACT

The present invention relates to a fire-fighting apparatus comprising a self-propelled, power-operated vehicle having interior surfaces defining a hose container receiving space, a hose container constructed and arranged to receive a length of hose therein, and a mounting assembly mounting the hose container on the vehicle for supported movement between (a) a retracted, hose containing position wherein the hose container is retracted within the hose container receiving space of the vehicle and (b) an extended, hose loading position wherein the hose container extends outwardly from the hose container receiving space. The hose container has an open top and an open end and is constructed and arranged such that a hose deploying operation can be performed by connecting an end of a hose stored in the container to a fluid supply and then moving the vehicle under power away from the fluid supply so that the hose deploys from the open end of the container and such that a hose reloading operation can thereafter be performed by moving the hose container to the hose loading position thereof and then moving the vehicle under power towards the fluid supply while a firefighter walks alongside the container and accesses the container through the open top thereof to aid in reloading the deployed length of hose into the container through the open end thereof. A power-operated moving system is provided to move the hose container between the extended, hose loading position thereof and the retracted, hose containing position thereof.

18 Claims, 5 Drawing Sheets

FIREFIGHTING APPARATUS WITH IMPROVED HOSE DEPLOYMENT AND RELOADING

The present application claims priority from U.S. Provisional Patent Application of Hunke, Ser. No. 60/099,935, filed Sep. 11, 1998, the entirety of which is incorporated into the present application by reference.

FIELD OF THE INVENTION

This invention relates to a fire fighting apparatus and more particularly to improvements therein relating to hose deployment from fire fighting vehicles and reloading hose onto fire fighting vehicles.

BACKGROUND OF THE INVENTION

The current industry standard for fire fighting vehicles with aerial ladders or buckets mounted thereon allows for hose storage space to either be above the booster tank or directly behind the tank under the bedded aerial assembly. Access to the hose for deployment is accomplished utilizing hose chutes. These chutes are usually small in size and are usually located high up on the rear of the apparatus. Another standard location is directly under the bedded aerial assembly on mid-mounted aerial vehicles. While the mid-mounted vehicles are more user-friendly while deploying the hose, it sometimes can be more difficult reloading the hose. The obvious reason for this is because the entire hose bed area is located directly under the bedded aerial.

Both the standard rear mount and mid-mount vehicles require the hose storage area to be located under the bedded aerial assembly. This requirement makes it very difficult and time-consuming to reload hose before leaving the scene. Aerial vehicles are not designed to be driven either forward or backward with the aerial assembly out of the inoperative bedded or carrying position. In the bedded position the aerial assembly provides more interference with the storage space therebelow than is the case when the aerial assembly is moved out of its inoperative bedded position. In some instances aerial vehicles have been reloaded by moving the vehicle backward with the aerial assembly out of its inoperative position. This is not a recommended procedure because the braces that engage the ground to enhance the vehicle's stability while the aerial assembly is raised must be moved to their inoperative positions as the vehicle is being moved.

Most, if not all fire departments, reload large diameter hose back onto a pumper vehicle or truck by backing up to or driving toward the hydrant. While the unit is being moved toward the hydrant the hose is simultaneously being reloaded onto the storage space in fore and aft folds. The conventional aerial design does not allow this same procedure to occur, assuming departments follow manufacturers' recommendations of never moving the truck while the aerial is in the raised position. The basic reason for this is because the design and location of the hose bed area on the conventional truck does not allow this procedure to occur.

There exists a need to provide a way to facilitate both hose deployment and hose reloading which will obviate the problems presented in aerial vehicles as noted above.

SUMMARY OF THE INVENTION

It is therefore an object of the present invention to meet the need described above. To achieve this object, the present invention provides a fire-fighting apparatus comprising a self-propelled, power-operated vehicle having interior surfaces defining a hose container receiving space, a hose container constructed and arranged to receive a length of hose therein, and a mounting assembly mounting the hose container on the vehicle. The mounting assembly enables the hose container to be moved between (a) a retracted, hose-containing position wherein the hose container is retracted within the hose container receiving space of the vehicle and (b) an extended, hose loading position wherein the hose container extends outwardly from the hose receiving space.

A power-operated moving system is associated with said hose container. The moving system moves the hose container between the retracted, hose containing position thereof and the extended, hose loading position thereof. The hose container has an open top and an open rear end. This arrangement allows a hose deploying operation to be performed by connecting an end of a hose stored in the container to a fluid supply, such as a hydrant, and then moving the vehicle under power away from the fluid supply so that the hose deploys from the open end of the container. This arrangement also allows a hose reloading operation to thereafter be performed by moving the hose container to the hose loading position thereof and then moving the vehicle under power towards the fluid supply while a firefighter walks alongside said container and accesses the container through the open top thereof to aid in reloading the deployed length of hose into the container through the open end thereof.

The use of the power-operated moving system is desirable from a practical viewpoint. In particular, the weight of the hose stored in the container is often so heavy that manual movement of the hose container is simply too difficult to be done.

It is preferred that the mounting assembly be constructed so that the hose container moves generally horizontally from the hose containing position thereof to an extended, intermediate position and then generally vertically down the intermediate position to the hose loading position. This provides maximum convenience for the firefighter walking alongside the container during hose reloading. However, the mounting assembly may be constructed so that the container's movement is only a horizontal movement.

The present invention is particularly useful in solving the problems heretofore associated with vehicles having aerial assemblies, such as ladders or buckets, mounted thereon. However, the principles of the present invention may be practiced on any type of fire-fighting apparatus.

Other objects, advantages, and features of the present invention will become apparent from the following detailed description, the accompanying drawings, and the appended claims.

DETAILED DESCRIPTION OF THE PREFERRED EMBODIMENT OF THE INVENTION

Figure 1:
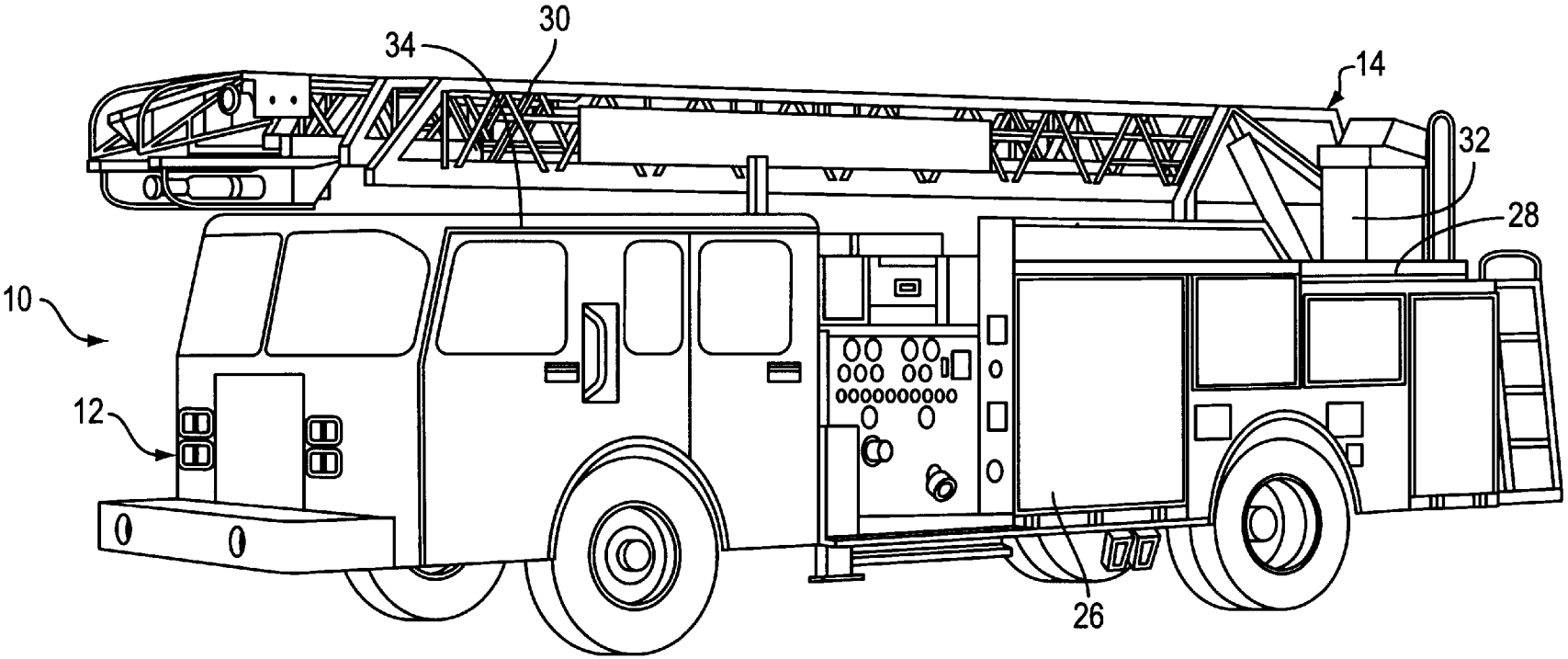
FIG. 1 is a perspective view of a fire fighting apparatus embodying the principles of the present invention.

FIG. 1 shows a fire fighting apparatus, generally indicated at 10, embodying the principles of the present invention. The apparatus 10 includes a self-propelled aerial vehicle, generally indicated at 12, having an aerial assembly, generally indicated at 14, mounted thereon in an inoperative bedded position wherein the aerial assembly 14 is stably carried by vehicle 12 for movement therewith. The aerial assembly 14 is constructed and arranged to be operable to move out of the inoperative bedded position thereof and into operative positions while the vehicle 12 is stationary. The aerial assembly 14 illustrated is an extensible ladder assembly, but may also be a pair of articulating arms with a bucket on the distal end for raising firefighters to elevated locations.

The apparatus 10 also includes a hose container, generally indicated at 16, and a mounting assembly, generally indicated at 18, constructed and arranged to mount the hose container 16 on the vehicle 12 for movement between a hose-containing position wherein the hose container 16 is retracted within the vehicle 12 below the aerial assembly 14 and a hose-loading position wherein the hose container 16 extends rearwardly of the vehicle 12 in a position enabling a firefighter to walk on the ground alongside the hose container 16 and aid in reloading a deployed length of hose into the container 16 while the vehicle 12 is moved toward the remote end of the hose. As shown, the hose container 16 includes an open rear end 20 facilitating hose deployment and reloading and an open top 22 enabling a fire fighter walking on the ground alongside the hose container 16 when in the hose-loading position thereof to aid in reloading a length of hose an organized compact arrangement therein (for example in a plurality of fore and aft folds) while the vehicle 12 is moving toward the remote end of a deployed length of hose.

The present invention contemplates a simple horizontal rectilinear motion of the hose container 16 between the hose containing and hose loading positions thereof. However, in order to provide maximum convenience for the fire fighter, the mounting assembly 18 is constructed so that the hose container 16 can be moved in a generally vertical downward manner into the hose reloading position from an intermediate rearward position and in a generally vertical upward manner back from the hose reloading position thereof into the intermediate rearward position before being moved forwardly into the hose containing position thereof.

The apparatus 10 also includes a power-operated moving system, generally indicated as 24, for affecting movement of the hose container 16 from the hose containing position thereof into the hose reloading position thereof and from the reloading position thereof after a length of hose has been reloaded therein back into the hose containing position thereof.

The aerial vehicle 12 is shown as being in the form of a Smeal Aerial Quint Apparatus Model 2003 manufactured by the Smeal Fire Apparatus Co. of Snyder, Nebr., modified in a manner hereinafter to be described in order to accommodate the hose container 16 of the present invention. As shown, the vehicle 12 includes the usual internal combustion engine, transmission mechanism and controls to make it a self-propelled vehicle. As shown, the vehicle 12 includes a suitable frame, generally indicated at 26, providing a rearward upper deck 28 on which the aerial assembly 14 is mounted. The aerial assembly 14 is shown in its inoperative bedded position in FIG. 1 and it will be noted that a telescopic ladder assembly 30 of the aerial assembly 14 disposed in inwardly telescoped relation extends forwardly from a movable mounting assembly 32 of the aerial assembly 14 carried on the rearward upper deck 28. As shown, the forwardly extending end portion of the telescopic ladder assembly 20 is disposed in supported relation with the upper surface of a forward cab section 34 of the vehicle frame 26. The movable mounting assembly 32 includes a power operated turntable and a power operated pivot mount in accordance with conventional practice which is capable of moving the telescopic ladder assembly 30 of the aerial assembly 14 out of the inoperative bedded position shown in FIG. 1 into a multiplicity of operative positions as is well known.

The vehicle frame 26 also provides an interior hose receiving space in the form of a hose-containing chamber 36 below the rearward upper deck 28 and the extent of the aerial assembly 14 thereabove. The rearward upper deck 28 forms the tipper extent of the chamber 36 which is defined along its lower extent by a floor panel 38 and along its sides by vertical side walls extending between the floor panel 38 and the upper deck 28. The mounting assembly 18 serves to mount the hose container 16 within the chamber 36 for movement between the hose-containing position wherein the container 16 is retracted within the chamber 36 and the hose reloading position wherein the container 16 is disposed rearwardly and downwardly with respect to the chamber 36.

The mounting assembly 18 includes a pair of iron or steel guide rails 42. One flange of each guide rail 42 is fixed to the associated chamber side wall 40 and the other flange is disposed horizontally above the floor panel 38 so as to provide guide channels between the horizontal flanges and the floor panel 38 which are open transversely toward one another. Mounted between the guide rails 42 is a carriage frame structure, generally indicated at 44, which includes a pair of longitudinally extending frame members 46 fixedly interconnected in parallel relation by an end frame member 48 and a spaced intermediate frame member 50. The carriage frame structure 44 is slidably mounted for movement between an inner limiting position and an outer limiting position by a pair of sliding blocks 52 fixedly mounted on the rearward upper surface of the floor panel 38 and a pair of longitudinally spaced upper and lower slide blocks 54 welded to the forward outer surfaces of the longitudinal frame members 46. As the carriage frame structure 44 is moved horizontally either rearwardly or forwardly between its limiting positions, the slide blocks 54 slide within the guide channels provided by the guide rails 42 and the overlying extent of the floor panel 38 and the lower surfaces of the longitudinal frame members 44 slide over the fixed slide blocks 52.

The hose container 16, as shown, includes a skeletonized supporting frame, generally indicated at 56, that fixedly carries a sheet metal basket, generally indicated at 57. The skeletonized frame 56 includes a pair of longitudinal frame members 58 fixed in parallel forward and rearward U-shaped relation by end frame members 60 and 62. The forward U-shaped end frame member 60 has its bight portion fixed between the forward ends of the longitudinal frame members 58 with its legs extending downwardly. Fixed between the legs of the forward U-shaped end frame member 60 and the adjacent forward end portions of the longitudinal frame members 58 is a pair of cam plates 64 having slanted U-shaped cam slots 66 formed therein. Slots 66 ride on a pair of rollers 68 mounted on the inside surfaces of the longitudinal frame members 46 of the carriage frame structure 44. The rearward U-shaped end frame member 62 has the free ends of its legs fixed to the rearward ends of the longitudinal frame members 58 with its bight portion spaced vertically therebelow. A pair of cam plates 70 are fixed between the legs of the U-shaped end frame member 62 and the rearward portions of the longitudinal frame members 58. The cam plates 70 include similar slanted U-shaped cam slots 72 which receive rollers 74 carried by the forward portions of the longitudinal frame members 46 of the carriage frame structure 44.

The sheet metal basket 57 includes a bottom wall 76 having side walls 78 extending upwardly from the sides thereof and a forward end wall 80 extending upwardly from the forward end thereof between the forward end of the side walls 78. The sheet metal basket 57 is fixed to the skeletonized frame 58 by securing the upper outer marginal edges of the side walls 78 to the interior surface of the longitudinal frame members 58 with the upper edge of the end wall 80 being fixedly supported on the bight portion of the rearward U-shaped frame member 60 and the front marginal edge of the bottom wall fixedly supported on the bight portion of the rearward U-shaped end frame member 62. The resultant hose container 16 provides both an open rear end and an open top.

It is to be understood that the arrangement disclosed herein for the hose container 16 is simply the preferred embodiment and the present invention is not intended to be limited to this arrangement. In contrast, the hose container 16 may be constructed in any suitable manner that can receive and store a length of hose.

The power operated moving system 24 is preferably hydraulically operated but other power systems, such as a system utilizing a mechanical transmission, could be utilized. As shown, a hydraulic motor 82 is fixedly mounted on the carriage frame structure 44 as by a bracket 84 fixed to the intermediate frame member 50. The hydraulic motor 82 has a pinion 86 fixed to its output shaft. The pinion 86 meshes with an elongated rack 88 fixed on the floor panel 38 between the guide rails 42. When the hydraulic motor 82 is energized the rotational meshing engagement of the pinion 86 with the rack will affect movement of the carriage frame structure between its limiting position with the direction of movement determined by the direction of movement of the hydraulic motor. It will be understood that suitable system of controls (not shown) are provided to operate the hydraulic motor 82 in opposite directions and to cease operation of the hydraulic motor 82 when the carriage frame structure 44 reaches its forward and rearward limiting positions.

The power operated moving system also includes a hydraulic piston and cylinder unit 90 for moving the hose container 16 between the intermediate rearward position when the carriage frame structure 44 has been moved into its rearward limiting position and the reloading position thereof which is disposed downwardly and rearwardly from the intermediate rearward position thereof.

Figure 6:
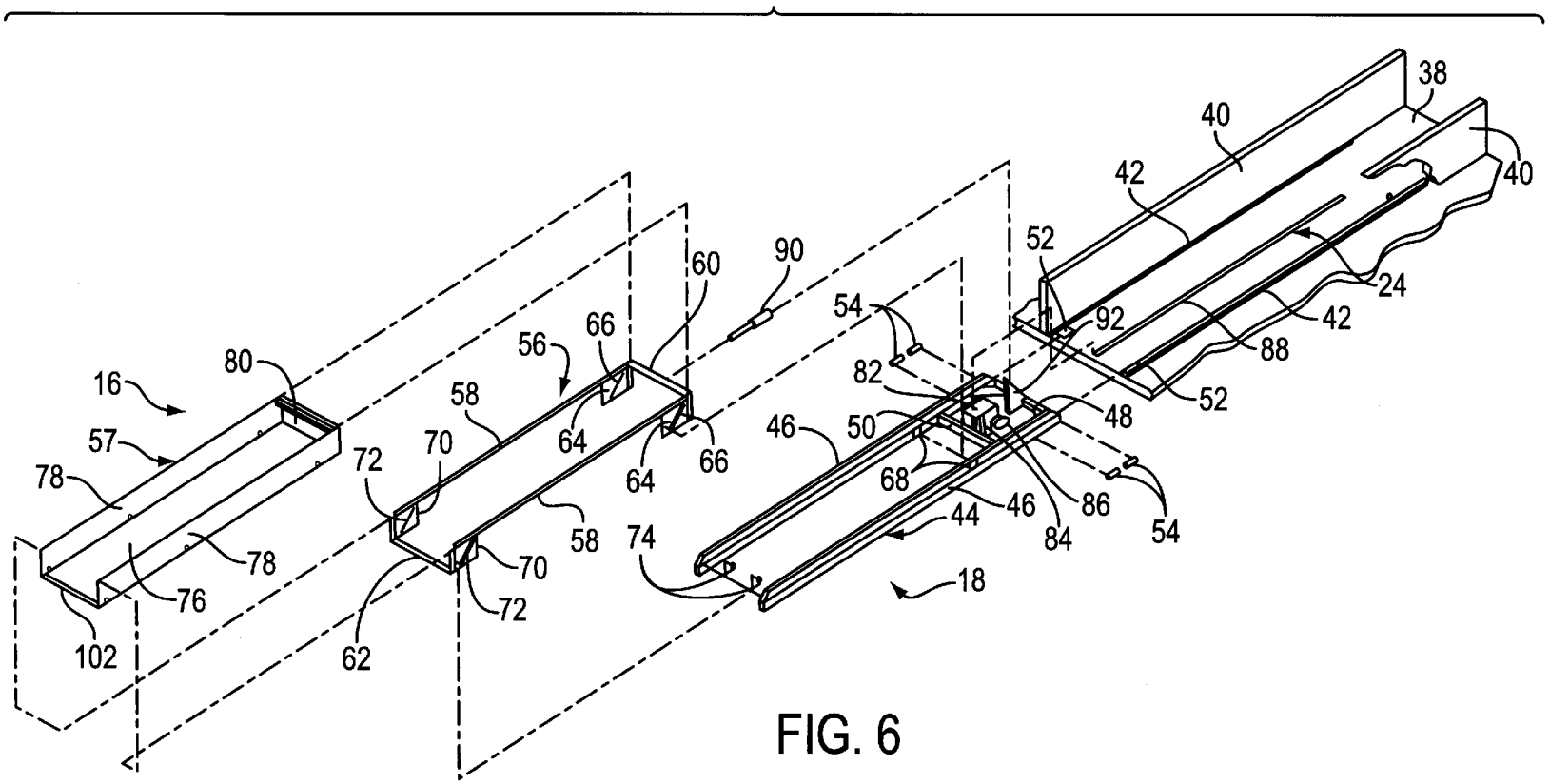
FIG. 6 is an exploded perspective view of the components of the hose container and the mounting assembly therefor including the power operated moving system including a fragmentary view of the structure defining a portion of the chamber which receives the hose container.
Figures 7, 8:
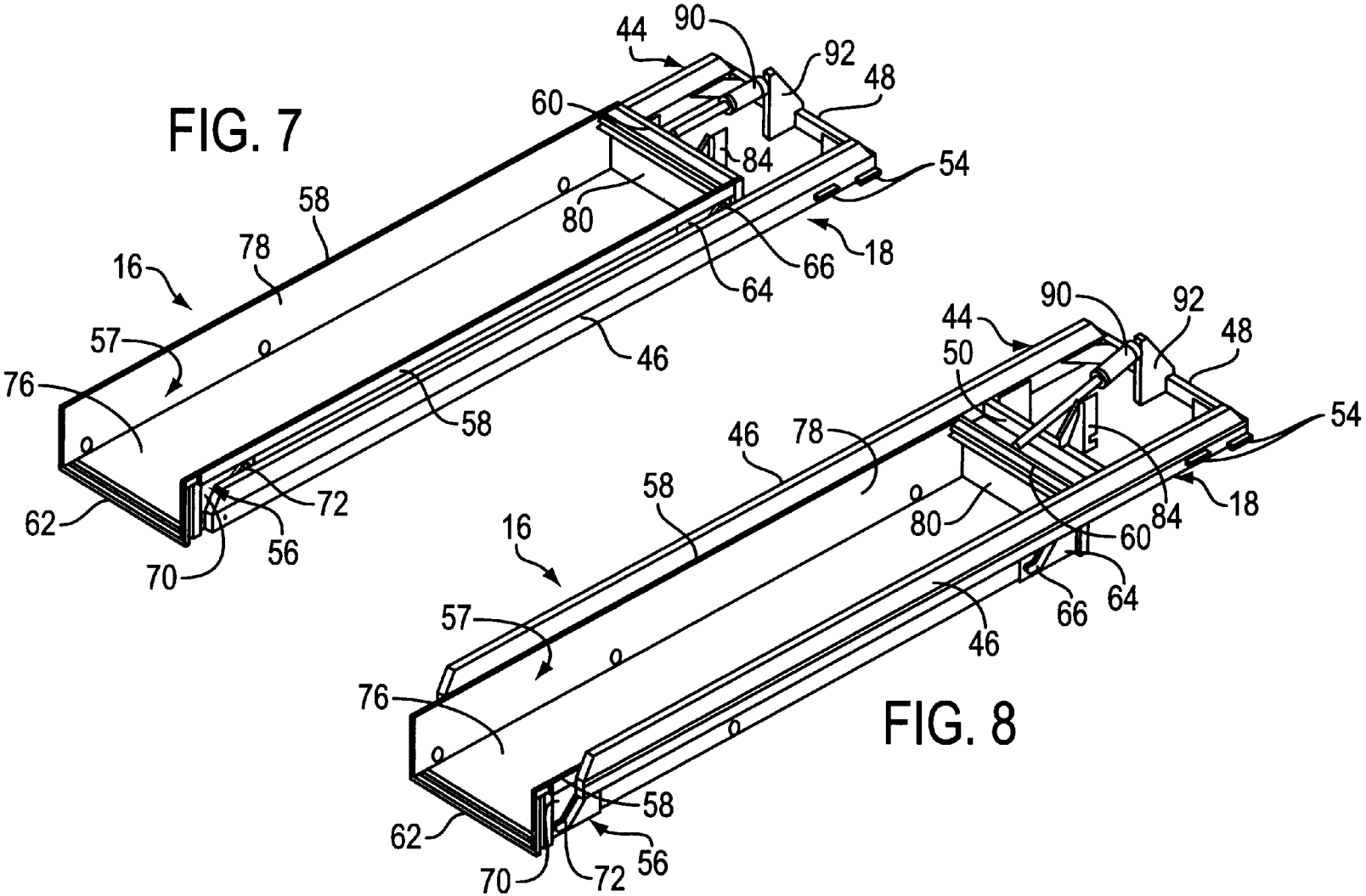
FIG. 7 is a perspective view of the hose container and the mounting assembly thereof showing the same in the hose-containing position thereof.
FIG. 8 is a view similar to FIG. 7 showing the hose container in its reloading position.

As best shown in FIGS. 6–8, the hydraulic piston and cylinder unit 90 has its piston end pivoted to the center of the bight portion of the U-shaped end frame member 60 of the skeletonized frame 56 and its cylinder end pivoted to a bracket 92 fixed to the center of the end frame member 48 of the carriage frame structure 44. The hydraulic piston and cylinder unit 90 is double acting and when operated in one direction moves the hose container 16 from the intermediate rearward position thereof into the reloading position and when operated in the other direction moves the hose container 16 from the reloading position thereof into the intermediate rearward position thereof. Here again, a system of controls (not shown) is provided to operate the hydraulic piston and cylinder unit 90 in either direction and cease the operation when the hose container reaches either position. The manually operable controls of the control system that initiate the movement of the hose container 16 from the hose containing position thereof and the reloading position thereof are preferably available at the rear of the vehicle 12.

Figure 2:
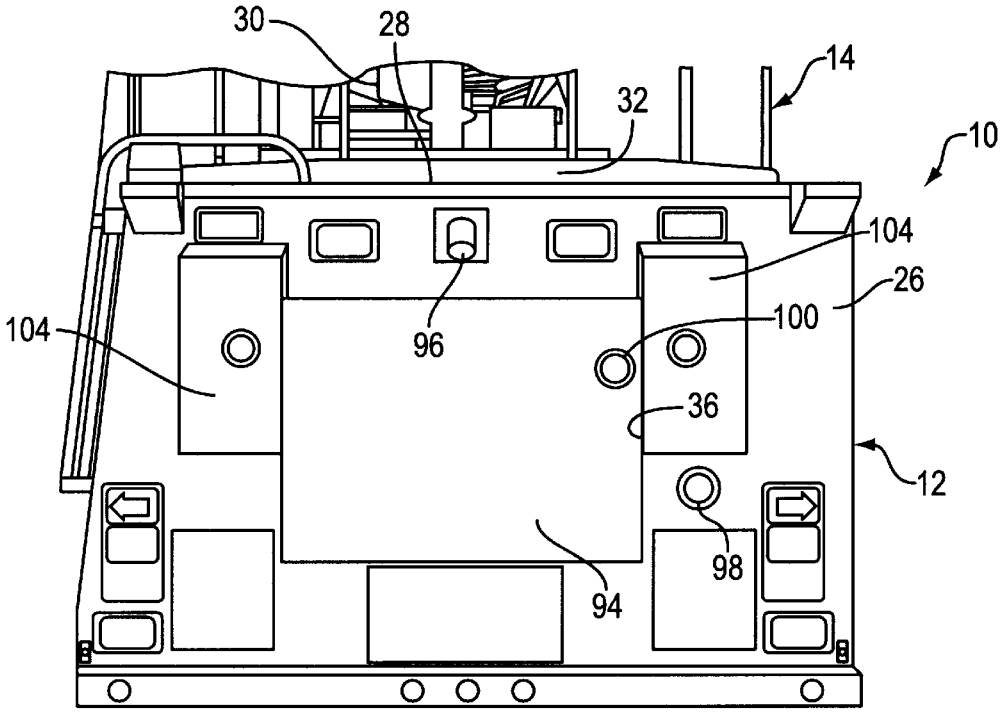
FIG. 2 is a fragmentary rear elevational view of the apparatus shown in FIG. 1 showing the hose container of the present invention in its hose-containing position within the vehicle with the door to the hose-containing compartment closed.

When the hose container 16 is disposed in the hose containing position, the rearward end of the chamber 36 is preferably closed by a door 94 which may be of any desirable construction. The door 94 shown in FIG. 2 is a tarp-like door 94 which is closed by detachable snap-lock fasteners to the peripheral rim defining the rearward end of the chamber 36. A horizontally hinged and releasably lockable rigid door may be provided instead as well as a pair of vertically hinged doors or a roll top.

Figure 3:
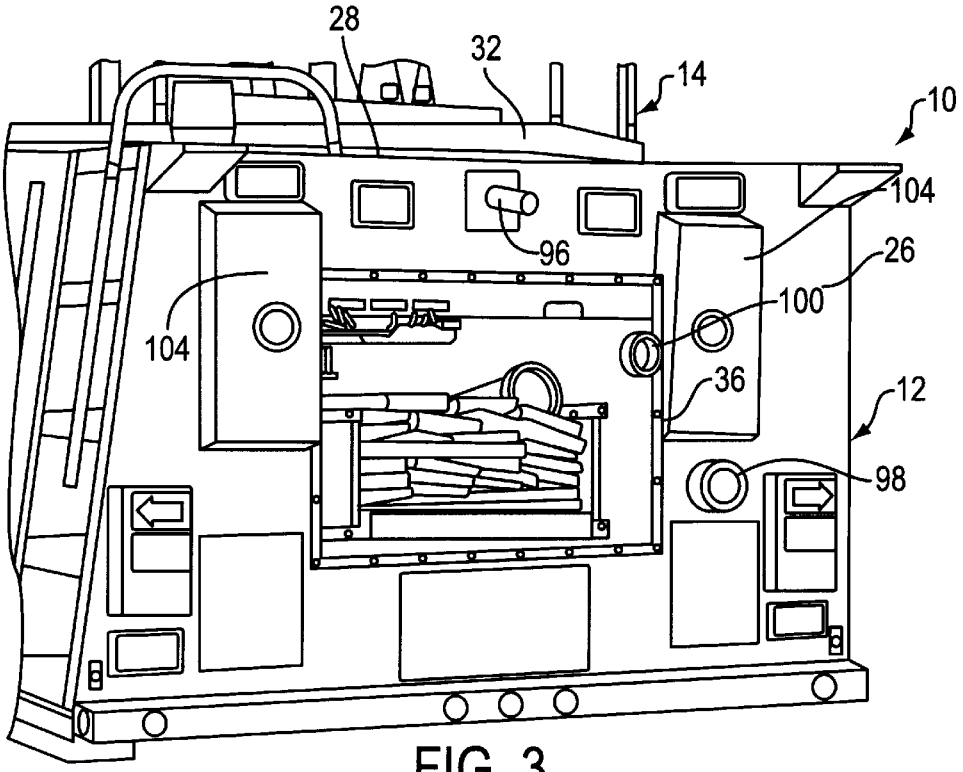
FIG. 3 is a fragmentary perspective view of the rear of the apparatus shown in FIG. 1 with the door open.
Figure 4:
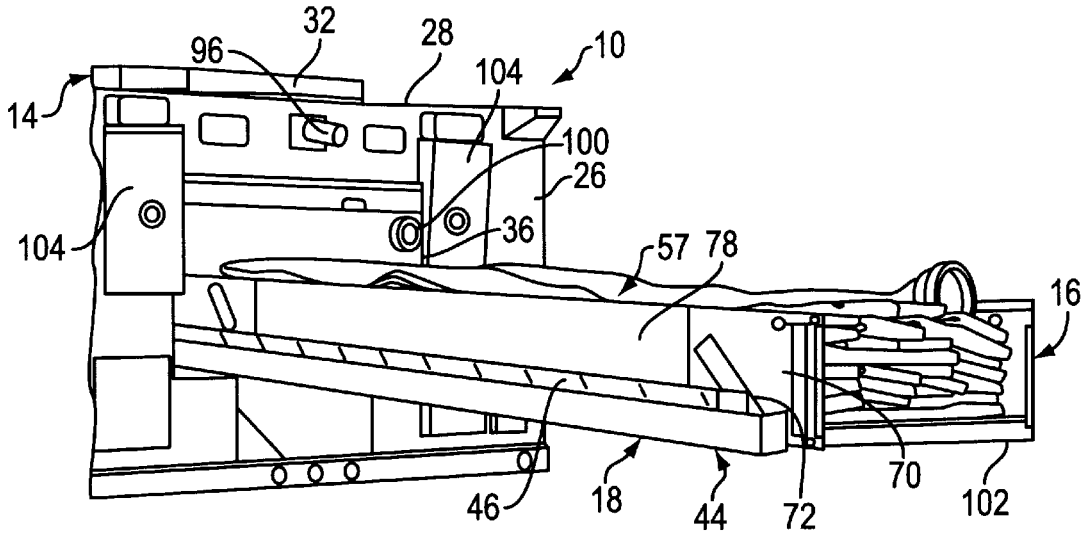
FIG. 4 is a view similar to FIG. 3 showing the hose container in its rear intermediate position.
Figure 5:
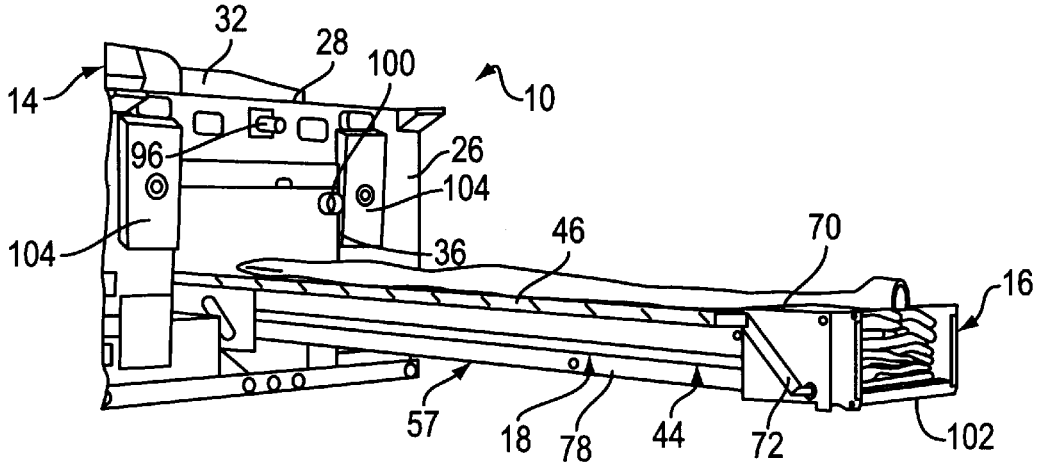
FIG. 5 is a view similar to FIG. 4 showing the hose container in its final hose-reloading position.

The operation of the present invention contemplates a backing up movement of the vehicle during the reloading operation. As an optional feature in order to provide the driver of the vehicle 12 with greater rearward visibility than is provided by the rear view mirrors, a television camera and monitor system 96 may be provided. The television camera of the system 96 is mounted on the rear of the vehicle as shown in FIGS. 2 and 3 while the television monitor of the system 96 is mounted on the dashboard within the cab of the vehicle just to the right of the driver's station. The television system 96 may be of any suitable known construction.

Since the present invention involves a reloading procedure where a user is walking on the ground alongside the hose container 16 while the container 16 is in the hose reloading position thereof, it is desirable to provide the manual controls for the power operated moving system 24 at the rear of the vehicle as aforesaid. In this regard, it is also within the contemplation of the present invention to relocate an inlet pipe 98 for the pump of the hose set-up of the aerial assembly 14 to be conveniently accessible from the rear of the vehicle, as shown in FIGS. 2 and 3. The inlet pipe 98 is distinguished from the usual pump by-pass inlet pipe 100 at the rear of the vehicle.

OPERATION

In using the fire fighting apparatus 10 in a hose-deploying procedure, the vehicle 12 is driven to the nearest hydrant with the hose container 16 disposed in the hose containing position thereof within the chamber 36 and the door 94 closing the rearward end of the chamber 36. The hose container 16 contains a suitable length of hose arranged in a plurality of fore and aft folds. A typical example is 1,000 feet of 5 inch diameter hose. Dividers can be installed to contain various types of desired hose loads, such as 600 feet of 5 inch hose or 3 inch hose. Once the vehicle has reached the hydrant, the door 94 is opened and the last coupler is pulled out of the chamber 36 and hooked to the hydrant to begin deployment. The vehicle 12 can then be driven to the fire site with the hose paying out of the open rear end of the chamber 36 and the open end of the container 16 as the vehicle is moved.

The low open location in the disclosed embodiment allows a firefighter to open the rear access door 94, pull out the last coupler, hook it to the hydrant and begin deployment. No reaching up to the hose chute is necessary. Most hose chutes are usually located at least 5 feet from ground level. The higher the chute opening, the more damage can occur to the couplers when they hit the ground if dropped. That is, the higher they are the harder they fall. The low design of the present invention minimizes the potential damage to hose couplers while being deployed.

A recurring problem with conventional designs occurs when deploying hose while making a 90-degree corner while moving the vehicle to the proper set-up position to attack the fire. The standard hose chute design can cause problems during this common situation. The hose couplers can get caught up on the chute while exiting the chutes and cause damage to the hose, vehicle, or both. Another unwanted result is the drag friction of the hose. Chute design can cause the hose to pull, twist, and slide. These unwanted recurring problems that have been viewed as the status quo can now be minimized if not eliminated altogether by utilizing the principles of the present invention.

The open low-to-the-ground design of the present invention allows the hose to deploy rapidly with minimum interference and possibility of damage. Rollers 102 are installed on the end of the basket 57 to maximize ease of both hose deployment and reloading of hose.

The fire fighting apparatus 10 with the hose container 16 is particularly advantageous during the reloading procedure. The operator can initiate reloading while standing on the ground at the back of the vehicle 12. By operating the manual controls (not shown) which are located there, the power operated moving system 24 is actuated to move the empty or partially empty hose container 16 from the hose containing position thereof into the reloading position thereof. As previously indicated, the hydraulic motor 82 driving pinion 86 in meshing engagement with the rack 88 moves the hose container 16 together with the carriage frame structure 44 rearwardly into an intermediate rearward position. Thereafter, the hydraulic piston and cylinder unit 90 moves the hose-containing structure 16 downwardly and rearward with respect to the carriage frame structure 44 into the reloading position thereof. In this position the highest point of the hose container 16 is preferably less than 52 inches above the ground.

Once the empty hose container 16 has been moved, the vehicle can be backed up toward the hydrant utilizing the television system 96 or the rearview mirrors. As the vehicle is backed up, a firefighter standing on the ground alongside the extended hose container 16 aids in arranging the hose within the hose container 16 in a plurality fore and aft fold. Once all the hose has been loaded, the operator simply actuates the manual controls at the rear of the vehicle 12 to return the loaded hose container into the hose containing position thereof and then closes the door 94.

Another added bonus of the present invention is the fact the hose is stored in an enclosed area that is out of the elements. More and more fire departments are having the aerial manufacturers install hose bed covers on their vehicles. These hose bed covers are somewhat expensive, less than convenient to use, are easily damaged and do a poor job of keeping the water and other elements from the hose. The present invention eliminates the use of hose bed covers altogether because the hose is stored under the upper deck 8 when the hose container 16 is retracted to the hose containing position thereof. It is to be understood, however, that the principles of the present invention may be practiced in a vehicle wherein one of these hose bed covers are used. Usually, the vehicle would not be constructed in the way, but there exists a potential to retrofit certain vehicles with a hose container 16.

The steel substructure assembly is painted black. Reflective tape and flashing lights are installed for nighttime operation. The aluminum hose box is sprayed with black line-x for durability and corrosion protection while fiberglass Dura-Dek flooring is installed for ventilation.

The NFPA recommended ground ladder compliment is conveniently located at the rear of the truck. All ground ladders are enclosed away from the elements. Each respective ground ladder can be removed individually. Access doors 104 are located at the rear of the apparatus.

It can thus be appreciated that the objections of the present invention by the foregoing preferred embodiment. It is to be understood, however, that the foregoing preferred embodiment is provided solely to illustrate the structural and functional principles of the present invention and is not intended to be limiting. To the contrary, the present invention is intended to encompass all alterations, substitutions, and modifications within the spirit and scope of the appended claims.

It should be noted that the appended claims do not have limitations phrased in the "means or step for performing a specified function" format permitted by 35 U.S.C. § 112, paragraph 6. This is to make clear that the appended claims are not to be interpreted under §112, paragraph 6 as being limited solely to the structure, material, or acts described in the present application and their equivalents.

What is claimed is:

1. A fire-fighting apparatus comprising:

a self-propelled, power-operated vehicle having interior surfaces defining a hose container receiving space, a hose container constructed and arranged to receive a length of hose therein;

a mounting assembly mounting said hose container on said vehicle for supported movement between (a) a retracted, hose containing position wherein said hose container is retracted within the hose container receiving space of said vehicle and (b) an extended, hose loading position wherein said hose container extends outwardly from said hose container receiving space and is supported thereat;

a power-operated moving system associated with said hose container, said moving system being constructed and arranged to move said hose container between the retracted, hose containing position thereof and the extended, hose loading position thereof;

said hose container having an open top and an open end, said hose container being constructed and arranged such that (a) a hose deploying operation can be performed by connecting a free end of a hose stored in said container to a fluid supply and then moving said vehicle under power away from said fluid supply so that the hose deploys from the open end of said container and (b) a hose reloading operation can thereafter be performed by operating said power-operated moving system so as to move said hose container to said hose loading position thereof and then moving said vehicle under power towards the hose free end while a firefighter walks alongside said container and accesses said container through the open top thereof to aid in reloading the deployed length of hose into said container through the open end thereof.

2. A fire fighting apparatus according to claim 1, wherein said power operated moving system and said mounting assembly are constructed and arranged such that said moving system can move said hose container between said retracted, hose containing position thereof and an extended, intermediate position spaced above the ground and wherein said power operated moving system and said mounting assembly are constructed and arranged such that said moving system moves said hose container in a generally vertical manner between said extended, intermediate position and said hose loading position thereof with said hose container being lowered towards the ground from the intermediate position thereof when in the hose loading position thereof.

3. A fire fighting apparatus according to claim 2, wherein said power-operated moving system is hydraulically powered.

4. A fire fighting apparatus according to claim 3, wherein said hydraulically driven moving system comprises a hydraulic piston and cylinder connected to said hose container, said hydraulic piston and cylinder being constructed and arranged to move said hose container generally vertically between the extended, intermediate position thereof and the hose loading position thereof.

5. A fire fighting apparatus according to claim 2, wherein said mounting assembly comprises a pair of rails that move together with said hose container and support said hose container as it is being moved between the retracted, hose containing position thereof and the extended, intermediate position thereof, said rails and said hose container being constructed and arranged such that said hose container moves in a generally vertical manner relative to said rails between the extended, intermediate position thereof and the hose loading position thereof.

6. A fire fighting apparatus according to claim 5, wherein said rails and said hose container are constructed and arranged such that said hose container moves downwardly and outwardly relative to said rails between the extended, intermediate position thereof and the hose loading position thereof.

7. A fire fighting apparatus according to claim 6, wherein said hose container has a pair of angled slots on opposing sides thereof and wherein said rails each have a pin that is slidably received in an associated one of said angled slots, said pins and said slots being configured to guide the downward and outward movement of said hose container relative to said rails between the intermediate position thereof and the reloading position thereof.

8. A fire fighting apparatus according to claim 1, further comprising an aerial assembly mounted on said vehicle for movement therewith, said aerial assembly being movable between (a) a lowered, inoperative position wherein said aerial assembly is located above said hose container receiving space and (b) a raised, operative position wherein said aerial assembly is supported on said vehicle and provides for access to elevated locations.

9. A fire fighting apparatus according to claim 8, wherein said power operated moving system and said mounting assembly are constructed and arranged such that said moving system can move said hose container between said retracted, hose containing position thereof and an extended, intermediate position spaced above the ground and wherein said power operated moving system and said mounting assembly are constructed and arranged such that said moving system moves said hose container in a generally vertical manner between said extended, intermediate position and said hose loading position thereof with said hose container being lowered towards the ground from the intermediate position thereof when in the hose loading position thereof.

10. A fire fighting apparatus according to claim 9, wherein said power-operated moving system is hydraulically powered.

11. A fire fighting apparatus according to claim 10, wherein said hydraulically driven moving system comprises a hydraulic piston and cylinder connected to said hose container, said hydraulic piston and cylinder being constructed and arranged to move said hose container generally vertically between the extended, intermediate position thereof and the hose loading position thereof.

12. A fire fighting apparatus according to claim 9, wherein said mounting assembly comprises a pair of rails that move together with said hose container and support said hose container as it is being moved between the retracted, hose containing position thereof and the extended, intermediate position thereof, said rails and said hose container being constructed and arranged such that said hose container moves in a generally vertical manner relative to said rails between the extended, intermediate position thereof and the hose loading position thereof.

13. A fire fighting apparatus according to claim 12, wherein said rails and said hose container are constructed and arranged such that said hose container moves downwardly and outwardly relative to said rails between the extended, intermediate position thereof and the hose loading position thereof.

14. A fire fighting apparatus according to claim 13, wherein said hose container has a pair of angled slots on opposing sides thereof and wherein said rails each have a pin that is slidably received in an associated one of said angled slots, said pins and said slots being configured to guide the downward and outward movement of said hose container relative to said rails between the intermediate position thereof and the reloading position thereof.

15. A fire fighting apparatus according to claim 1, wherein said hose container receiving space opens to the rear of said vehicle and wherein said hose container extends rearwardly from said hose container receiving space when in the hose loading position thereof.

16. A fire-fighting apparatus according to claim 1, wherein said hose container has a bottom wall and a pair of side walls extending upwardly from said bottom wall.

17. A fire-fighting apparatus according to claim 16, wherein said hose container has an exterior skeletal frame that connects said hose container to said mounting assembly.

18. A fire-fighting apparatus according to claim 15, further comprising:

a television monitor located in view of the vehicle's driver;

a camera operatively connected to said television monitor, said camera being aimed towards the rear of the vehicle and being adapted to transmits images of the area rearward of the vehicle to the television monitor, thereby allowing the vehicle driver to move the vehicle rearwardly while watching the television monitor.

* * * * *